US005106022A

United States Patent [19]

Pook

[11] Patent Number: 5,106,022

[45] Date of Patent: Apr. 21, 1992

[54] SPRAY NOZZLES

[76] Inventor: Francis Pook, Vine House, Northwick, Bristol, United Kingdom

[21] Appl. No.: 576,517

[22] PCT Filed: Apr. 7, 1989

[86] PCT No.: PCT/GB89/00385

§ 371 Date: Oct. 4, 1990

§ 102(e) Date: Oct. 4, 1990

[87] PCT Pub. No.: WO89/09654

PCT Pub. Date: Oct. 19, 1989

[30] Foreign Application Priority Data

Apr. 12, 1988 [GB] United Kingdom ..... 8808574

[51] Int. Cl.[5] ..... B05B 1/34

[52] U.S. Cl. ..... 239/463

[58] Field of Search ..... 239/463–464, 239/468, 490, 589, 590, 590.5

[56] References Cited

U.S. PATENT DOCUMENTS

| | | | |
|---|---|---|---|
| 2,015,611 | 9/1935 | Wettstein | 239/464 |
| 4,274,595 | 6/1981 | Yamin . | |
| 4,415,275 | 11/1983 | Dietrich . | |

FOREIGN PATENT DOCUMENTS

| | | | |
|---|---|---|---|
| 554494 | 2/1957 | Belgium . | |
| 2141038 | 1/1973 | France . | |
| 7211160 | 2/1973 | Netherlands . | |
| 65092 | 4/1925 | Sweden | 239/490 |
| 1121015 | 10/1984 | U.S.S.R. | 239/463 |

*Primary Examiner*—Andres Kashnikow
*Assistant Examiner*—Lesley D. Morris
*Attorney, Agent, or Firm*—Young & Thompson

[57] ABSTRACT

A spray nozzle has a swirl chamber and delivery passage with its downstream end divergent. The downstream end is substantially conical with a cone angle in the range 10 degree to 30 degree and terminates with a sharply angled transition intothe forward face of the nozzle.

8 Claims, 1 Drawing Sheet

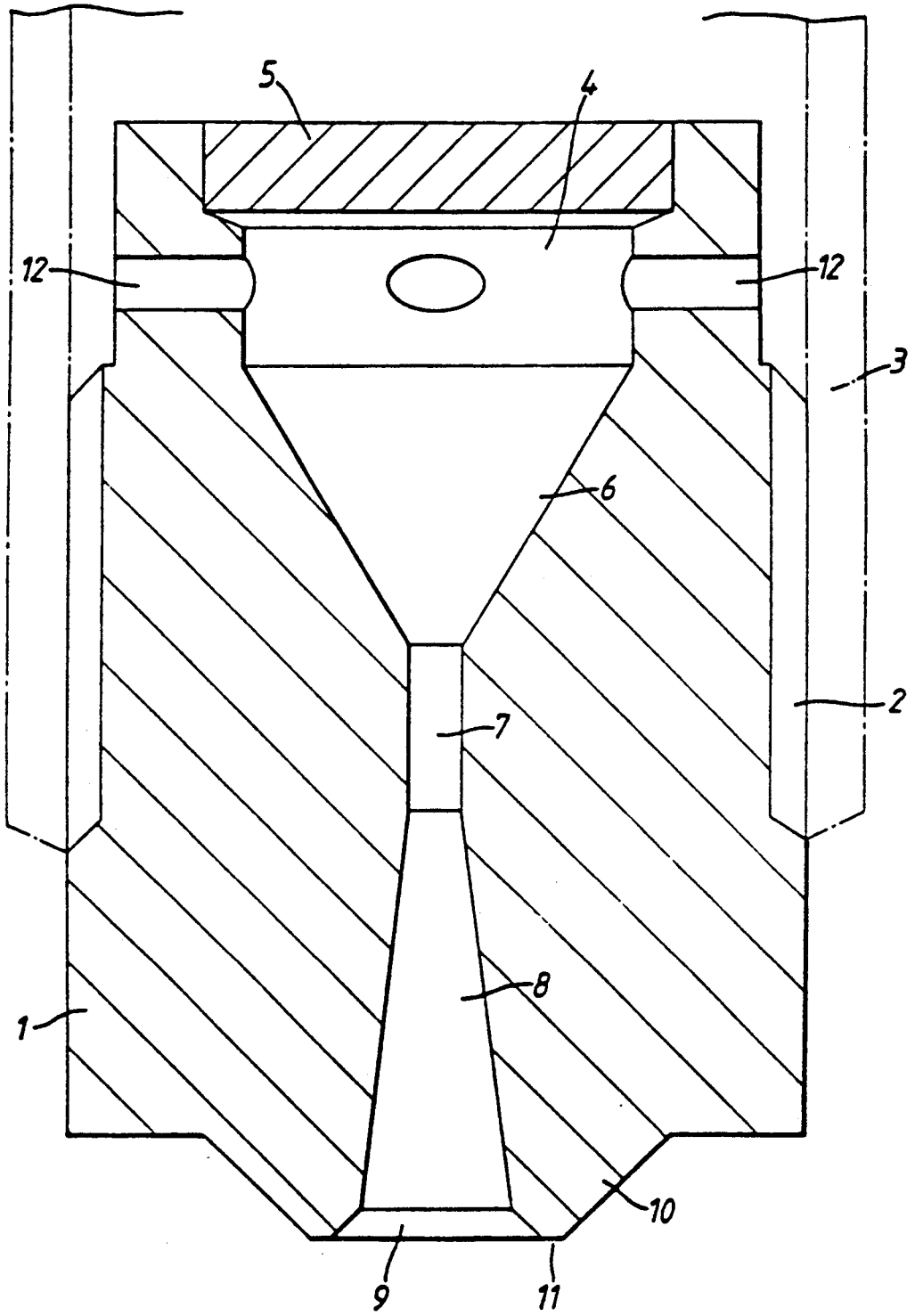
5
4
12
12
3
6
2
7
8
1
10
9
11

SPRAY NOZZLES

This invention relates to spray nozzles and is primarily concerned with those for bathroom showers, although there is no reason why the principles should not be applied to nozzles for other purposes, and for liquids other than water.

A good bathroom shower should be capable of operating over a wide pressure range and in particular to be effective at low pressures and with low flow rates, while retaining an acceptable shower pattern.

The instant water heaters that supply showers nowadays are mostly electric. They tend to be very hungry of energy, and special heavy duty cables normally have to be run to the heater. Much for the heat consumed is often wasted by an inefficient spray pattern which misses much of its target unless the latter is very close.

Another problem is that the spray heads tend to clog up with lime and other foreign matter carried by the water. In particular, the "rose" through which the spray finally emerges generally has very fine holes which do not take long to clog, and while the shower may continue to operate while many of them are blocked, it will naturally be operating at even less efficiency than before. Also, the dismantling and cleaning of very small apertures is a fiddly and tiresome business which tends to be put off too long.

There are nozzles (without a rose) which attempt to spread a stream of water into a conical pattern. However, they tend to concentrate the droplets into a conical "shell", with very few in the middle, or have a central stream with a much less dense outer band of droplets.

It is the aim of this invention to provide a spray nozzle where many of these drawbacks should largely be overcome.

According to the present invention there is provided a spray nozzle having a swirl chamber and a delivery passage extending therefrom with its downstream end divergent, characterised in that the downstream end is substantially straight conical with a cone angle in the range 10° to 30° and terminates with a sharply angled transition into the delivery end face of the nozzle.

Preferably, the cone angle is rather less than 30°, and ones of 14° to 20° have been found to be very effective.

The angled transition may be a chamfer, that is a frusto-conical surface with a substantially larger cone angle than the downstream end of the delivery passage. Its width may be in the range 0.5 to 1.5 mm. There will then be two sharp transitions, one between that downstream end and the chamfer, and the other between the chamfer and the end face of the nozzle, which in the zone around the mouth of the passage will generally be perpendicular to the axis of that passage.

There may also be a throat of substantially constant cross-section preceding the downstream end of the delivery passage, and this will generally be of circular cross-section with a diameter in the range of 1 to 6 mm (1.6 mm has been found very effective) and a length preferably in the range 2 to 6 mm, although shorter lengths may be used.

The mouth of the downstream end is preferably in a projecting boss whose outer side slopes inwardly and forwardly, and whose extremity provides said delivery end face. The width of this end face, from mouth to sloping side is preferably in the range 0.5 to 1.5 mm.

Experiments have shown that this geometry breaks up the water into fine droplets without forcing the water through narrow 'pinholes', and moreover the distribution of those droplets over the spray cone is acceptably even.

The upstream end of the delivery passage will generally be convergent from the swirl chamber, in which case the whole passage will be like a venturi.

In the preferred form, the swirl chamber is cylindrical with a plurality of generally tangential inlets, and these can act as a filter preventing ingress of foreign bodies over a certain size. But they will generally be larger than the fine apertures in a rose, and therefore will be far less prone to becoming clogged. If they do, there are fewer of them to clean out, and being larger, the job is rather easier. They may all be angled similarly, although there could be some differentiation, and indeed some inlets could direct the water clockwise while others direct it anticlockwise. They need not all be at the same axial position.

For a better understanding of the invention, one embodiment will now be described, by way of example, with reference to the accompanying drawing, in which the single figure is a diagrammatic axial section of a spray nozzle.

The nozzle is a generally cylindrical body 1 externally screw threaded at 2 to fit into a tubular member indicated in outline at 3 which creates an annular chamber around the rear end of the nozzle, which is at the top of the figure. The body 1 has a swirl chamber 4 co-axially within it, this being cylindrical and closed at the rear end by a plug 5. It develops into a coned portion 6 narrowing down to a throat 7, which then opens out into a flared passage 8 to the mouth 9 at the leading end of the nozzle, all these being co-axial with the body 1. This mouth is a chamfer within a frusto-conical boss 10 and there are abruptly angled transitions between itself and the passage 8 and the forward end face 11 of the nozzle. Each abrupt transition affects the nature of the spray from the nozzle and in particular the degree to which the spray is broken up into a distributed droplet spray. While a single sharp angle at the mouth has this breaking-up effect, experiments suggest that even better results are obtainable with the chamfer and two transitions. Also, the conical flank of the boss 10, which projects from the main body of the nozzle, causes the air current which is induced by the discharging droplets to flow inwardly and forwardly in a convergent manner to force many such droplets into the middle of the spray cone, countering the tendency for them to concentrate on the outside.

Leading laterally into the swirl chamber 4 through the cylindrical wall are inlets 12, their outer ends being open to the annular chamber defined by the member 3. These inlets are equally spaced around the chamber and each is generally tangential to create a swirling action of the water, which is supplied through the member 3. The water discharges through the venturi 6, 7, 8 whose form is such that a conical spray of fine droplets is produced.

Angles and dimensions have been indicated above but to re-cap the cone angle of the passage 8 is between 10° and 30°, the throat is 1 to 6 mm in diameter and 2 to 6 mm in length, and the width of the chamfer 9 and of the forward end face 11 is 0.5 to 1.5 mm. The throat could be shorter than 2 mm or even omitted in particular circumstances, for example for low flows and/or pressures. The shorter the throat the faster the flow, but the greater the wear. As well as increasing the axial velocity, it will also increase the rotational velocity already engendered in the swirl chamber, and that increase will be related to its diameter. It has also been observed that the length of the coned passage 8 affects droplet size, this being fine for a short passage and becoming coarser the longer the passage. Thus by selecting the appropriate geometry for the nozzle, desired spray characteristics can be achieved quite easily.

I claim:

1. A spray nozzle having a swirl chamber and a delivery passage extending therefrom to a mouth at a forward end face transverse to the passage, said passage having a downstream end which is divergent and substantially conical and which has cone angle in the range 10° to 30°, said forward end face comprising a projecting boss with an outer side that slopes inwardly and forwardly, and said mouth comprising a chamfer creating two sharply angled transitions between said passage and said forward end face.

2. A nozzle as claimed in claim 1, characterised in that the cone angle is of the order 14° to 20°.

3. A nozzle as claimed in claim 1, characterised in that there is a throat of substantially constant cross-section preceding the downstream end of the delivery passage.

4. A nozzle as claimed in claim 3, characterised in that the throat is of circular cross-section with a diameter in the range 1 to 6 mm.

5. A nozzle as claimed in claim 3, characterised in that the length of the throat is in the range 2 to 6 mm.

6. A nozzle as claimed in claim 1, characterised in that the upstream end of the delivery passage is convergent from the swirl chamber.

7. A nozzle as claimed in claim 1, characterized in that the chamfer has a width between said transitions in the range of 0.5 to 1.5 mm.

8. A nozzle as claimed in claim 1, characterized in that said end face has a width, from mouth to sloping side, in the range of 0.5 to 1.5 mm.

* * * * *